US009105999B2

(12) United States Patent
Kung

(10) Patent No.: US 9,105,999 B2
(45) Date of Patent: Aug. 11, 2015

(54) LOCK DEVICE FOR ELECTRONIC APPARATUS

(71) Applicant: Tigerex Enterprise Co., Ltd., New Taipei (TW)

(72) Inventor: Ching-Hu Kung, New Taipei (TW)

(73) Assignee: Tigerex Enterprise Co., Ltd., New Taipei (TW)

( * ) Notice: Subject to any disclaimer, the term of this patent is extended or adjusted under 35 U.S.C. 154(b) by 0 days.

(21) Appl. No.: 14/208,671

(22) Filed: Mar. 13, 2014

(65) Prior Publication Data

US 2015/0017824 A1 Jan. 15, 2015

(30) Foreign Application Priority Data

Jul. 15, 2013 (TW) ..... 102213320 U
Sep. 6, 2013 (CN) ..... 2013 2 0554150 U

(51) Int. Cl.
*H01R 13/443* (2006.01)
*H01R 13/639* (2006.01)

(52) U.S. Cl.
CPC ..... *H01R 13/443* (2013.01); *H01R 13/6397* (2013.01)

(58) Field of Classification Search
USPC ..... 439/133, 134, 357; 70/57
See application file for complete search history.

(56) References Cited

U.S. PATENT DOCUMENTS

| | | | | |
|---|---|---|---|---|
| 4,812,131 | A * | 3/1989 | Sieverman | 439/134 |
| 5,190,466 | A * | 3/1993 | McVey | 439/304 |
| 5,344,329 | A * | 9/1994 | Faller | 439/133 |
| 6,991,479 | B2 * | 1/2006 | Miao | 439/133 |
| 7,160,137 | B1 * | 1/2007 | Yeh | 439/358 |
| 7,428,834 | B1 * | 9/2008 | Lee | 70/57 |
| 7,581,417 | B1 * | 9/2009 | Chen | 70/57 |
| 8,824,133 | B2 * | 9/2014 | Ko | 361/679.39 |
| 8,845,356 | B2 * | 9/2014 | Cheatham et al. | 439/357 |
| 2008/0041125 | A1 * | 2/2008 | Poppe | 70/57 |
| 2015/0017824 | A1 * | 1/2015 | Kung | 439/133 |

* cited by examiner

*Primary Examiner* — Alexander Gilman
(74) *Attorney, Agent, or Firm* — C. G. Mersereau; Nikolai & Mersereau, P.A.

(57) ABSTRACT

A lock device for electronic apparatus includes a lock body and a key member. The lock body includes a front end, a rear end, and a bottom side defined between the front and the rear end and having at least one retaining section provided thereon. The lock body is configured for inserting into a slot on an electronic apparatus. When the lock body is inserted into the slot, the bottom side of the lock body is located corresponding to a plurality of terminals in the slot with the retaining section abutted against inner sides of the terminals, so that the lock body is held in the slot to lock the same. The key member is configured for detachably engaging with a lock core structure of the lock body, so that the lock body can be inserted into and extracted from the slot only with the key member.

10 Claims, 14 Drawing Sheets

LOCK DEVICE FOR ELECTRONIC APPARATUS

FIELD OF THE INVENTION

The present invention relates to a lock device, and more particularly to a lock device for inserting into a slot on an electronic apparatus, so as to lock the slot.

BACKGROUND OF THE INVENTION

Generally, an electronic apparatus is provided with a narrow slot or an insertion slot, into which an access device can be inserted. The access device inserted into the slot can be programmed, or can read data stored in the electronic apparatus or write data into the electronic apparatus. The slot is internally provided with a plurality of terminals, which electrically contact with terminals correspondingly provided in the access device to achieve the purpose of power supplying, data transmission or online operation on the electronic apparatus. While the rapidly developed electronic technology brings a lot of conveniences to users, the users also encounter with many security problems in using various electronic apparatuses. For example, users' information and data stored in the electronic apparatuses are subject to the risk of being stolen or illegally copied by other unauthorized users. Therefore, it is necessary to provide safety devices for the slots on electronic apparatuses to limit the access of the slot by unauthorized users.

SUMMARY OF THE INVENTION

A primary object of the present invention is to provide a lock device having a lock body that can be inserted into a slot on an electronic apparatus to protect the slot from being accessed by any other access device, so that data stored in the electronic apparatus could not be arbitrarily read or recorded by unauthorized users via the slot.

Another object of the present invention is to provide a lock device having a lock body for inserting into a slot on an electronic apparatus, and the lock body is provided with a retaining section for firmly abutting against inner sides of a plurality of terminals in the slot to produce a locking force between the lock body and the terminals in the slot, preventing the lock body from being arbitrarily extracted from the slot.

A further object of the present invention is to provide a lock device having a lock body and a matching key member. The lock body has a lock core structure and the key member has a lock core engaging structure. Therefore, the lock body can be inserted into and extracted from the slot on an electronic apparatus only with the key member.

To achieve the above and other objects, the lock device for electronic apparatus according to the present invention includes a lock body and a key member. The electronic apparatus includes a slot, in which a plurality of terminals is provided for electrically contacting with a plurality of terminals in an access device; and the terminals in the slot respectively have a protruded section formed on a front end thereof. The lock body includes a front end, a rear end, and a bottom side defined between the front and the rear end and having at least one retaining section. When the lock body is inserted into the slot on the electronic apparatus, the bottom side is located in the slot corresponding to the terminals with the retaining section abutted against inner sides of the terminals, so that the lock body is held to a locked position in the slot.

Only with the key member, the lock body in the locked position can be extracted from the slot.

In a preferred embodiment, the lock body internally defines a receiving space and is provided on the rear end with an opening communicable with the receiving space. A front stop wall is provided in the receiving space opposite to the opening, and two abutment sections are formed in the receiving space at two opposite lateral ends of the opening. The rear end of the lock body is located in the slot without protruding from the slot when the lock body is held to the locked position in the slot.

In an embodiment, the lock body includes an upper half and a lower half, and the receiving space and the front stop wall are defined between the upper and the lower half of the lock body.

In the above embodiment, the upper half of the lock body includes an upper coupling edge extended along a periphery of the upper half and having an upper front section and an upper rear section, and the upper rear section is provided with an upper notch. The lower half includes a lower coupling edge extended along a periphery of the lower half and configured corresponding to the upper coupling edge, the lower coupling edge has a lower front section corresponding to the upper front section and a lower rear section corresponding to the upper rear section, and the lower rear section is provided with a lower notch corresponding to the upper notch. And, the upper notch and the lower notch together define the opening on the rear end of the lock body.

In the preferred embodiment, the key member is configured for detachably engaging with the opening of the lock body and includes a case, in which a slide element, a hooking element and an engaging element are disposed. The slide element includes a top panel, two lateral panels downward extended from two opposite lateral sides of the top panel, a top push knob located on and upward protruded from the top panel, and a driving plate forward projected from a front end of the top panel and having a first projected end. The two lateral panels are respectively externally provided with a stop rib. The hooking element is located below the slide element, and includes a main body, two ends of which are forward extended to form two laterally spaced extension arms corresponding to the driving plate of the slide element. The two extension arms are formed at respective free end with a hook, and have two facing sides that form two rearward outward slant sides. The engaging element includes a second projected end forward projected from the case. The second projected end is provided on two lateral sides with a small opening each; and the two extension arms of the hooking element are located inside the engaging element with the two hooks located corresponding to the two small openings. The second projected end is configured corresponding to the opening of the lock body for detachably inserting into the receiving space of the lock body via the opening, such that the small openings on the second projected end are located in the receiving space. When the slide element is forward slid for the first projected end to press against the two facing slant sides of the two extension arms of the hooking element, the two hooks at the free ends of the two extension arms are forced to expose from the two small openings and abut against inner sides of the two abutment sections of the lock body.

In an embodiment, the case of the key member includes an upper case having a through hole, via which the top push knob of the slide element exposes from the upper case; and a lower case being correspondingly closed to the upper case and internally having a middle portion. In the middle portion, there are provided a platform for supporting the hooking element thereon, and two outer panels located at two opposite lateral sides of the middle portion, such that a guide way is formed between each of the outer panels and the middle portion for receiving the two lateral panels of the slide element therein. The outer panels are respectively provided with at least one locating groove for correspondingly engaging with the stop ribs on the lateral panels of the slide element.

In another embodiment, the key member further includes a protective cover for fitting on the case to enclose the second projected end therein.

According to the preferred embodiment, the lock body includes a lock core structure located in the receiving space, and the key member includes a lock core engaging structure provided on the second projected end for fitly engaging with the lock core structure of the lock body. The lock core structure can be a raised pin or a channel, and the lock core engaging structure can be a channel or a raised pin matching the raised pin or the channel of the lock core structure.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
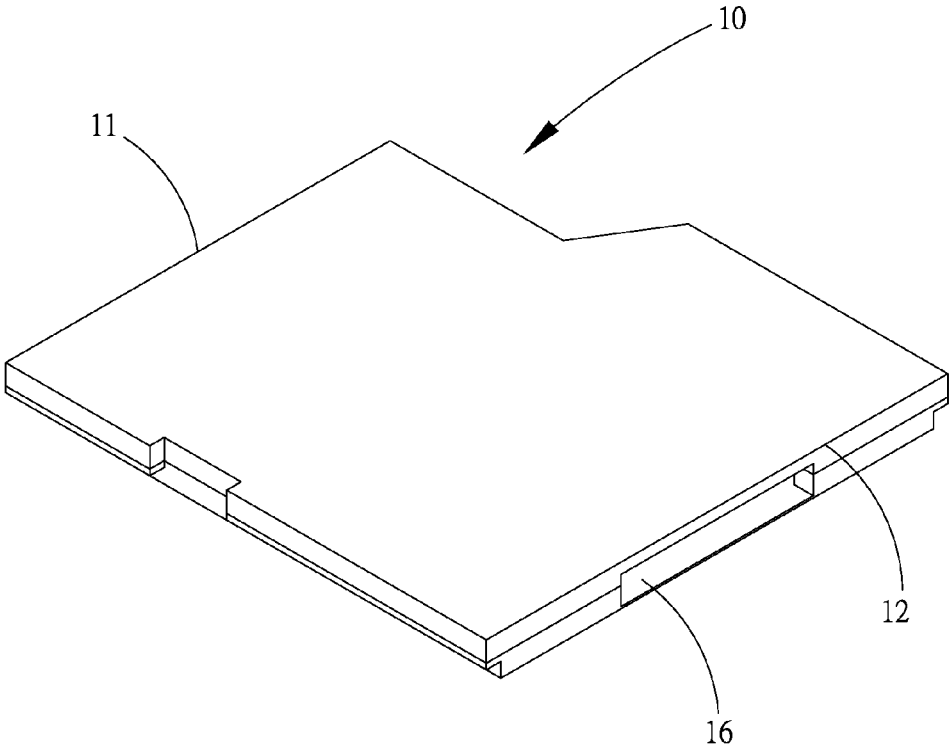
FIG. 1 is an assembled perspective view of a lock body for a lock device according to a preferred embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 2:
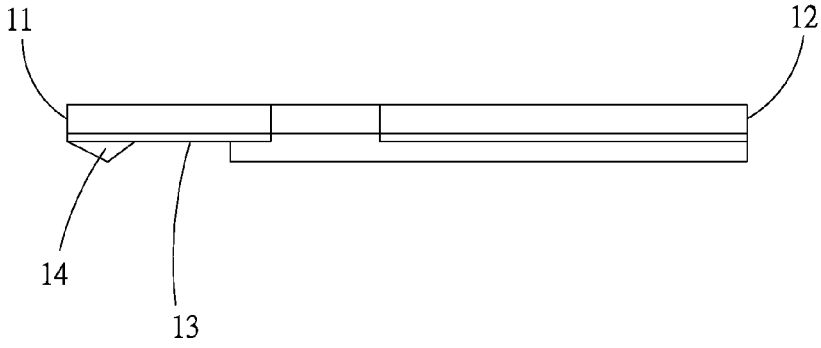
FIG. 2 is a side view of the lock body of FIG. 1.
Figure 3:
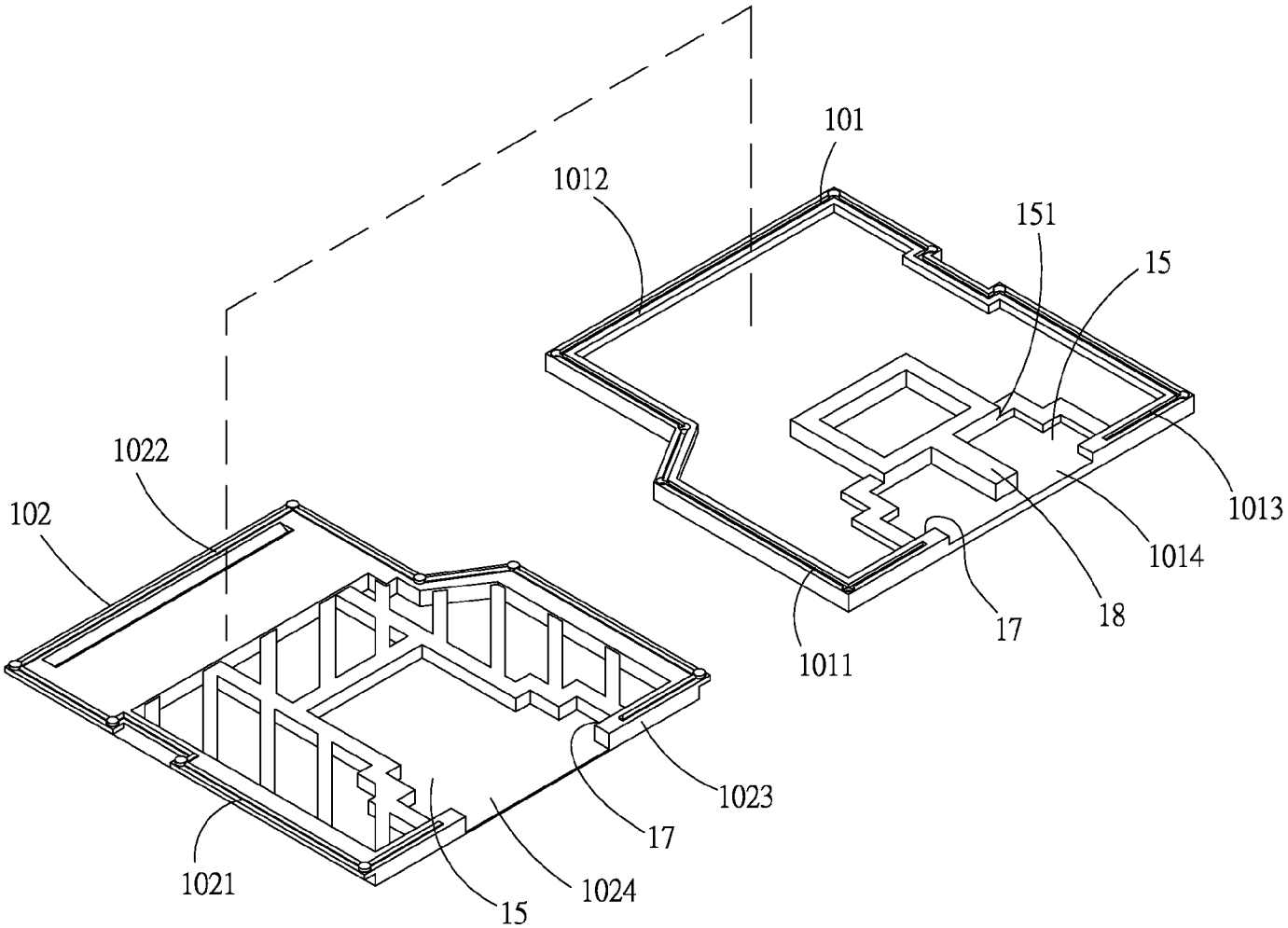
FIG. 3 is an exploded perspective view of the lock body of FIG. 1.
Figure 10:
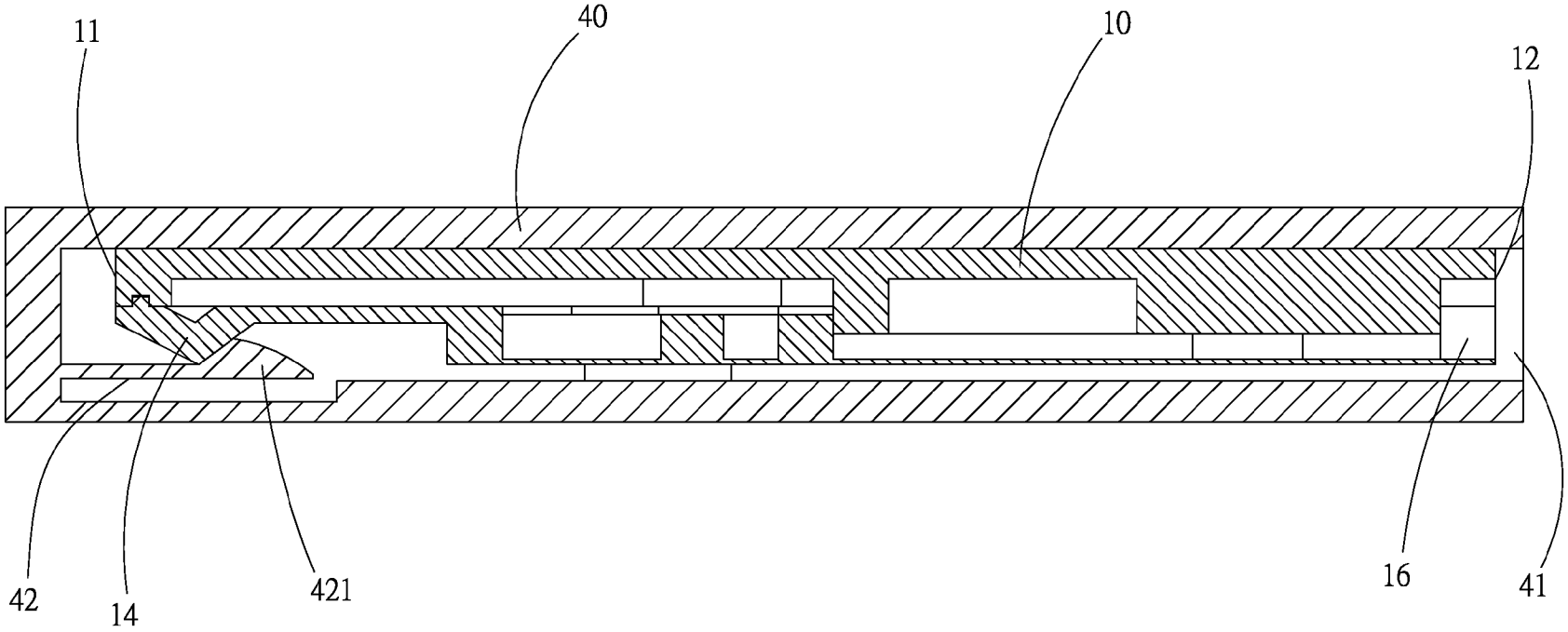
FIG. 10 is a sectional side view showing the lock body is inserted into a slot on an electronic apparatus to lock the slot.

The present invention relates to a lock device for electronic apparatus. The lock device includes a lock body 10 and a key member 20. Please refer to FIGS. 1, 2 and 3 that are assembled perspective view, assembled side view and exploded perspective view, respectively, of the lock body 10. As shown in FIGS. 1, 2 and 3, the lock body 10 has a front end 11, a rear end 12 and a bottom side 13 defined between the front end 11 and the rear end 12. When the lock body 10 is inserted into a slot 40 on an electronic apparatus, as shown in FIG. 10, the bottom side 13 of the lock body 10 is located corresponding to a plurality of terminals 42 in the slot 40 with at least one retaining section 14 provided on the bottom side 13 of the lock body 10 abutted against inner sides of the terminals 42. More detailed description of this portion will be made later. In an embodiment of the present invention, the retaining section 14 is in the form of a protruded hook; and in another embodiment of the present invention, the retaining section 14 is in the form of a recess. The lock body 10 can be differently shaped depending on the slot 40 of the electronic apparatus to be locked with the lock body 10. Preferably, the lock body 10 is in the form of a card, a thin sheet or a low-profile block. The lock body 10 internally defines a receiving space 15, and is provided on the rear end 12 with an opening 16 communicable with the receiving space 15. A front stop wall 151 is provided in the receiving space 15 opposite to the opening 16, and two abutment sections 17 are formed in the receiving space 15 at two opposite lateral ends of the opening 16.

In the preferred embodiment, the lock body 10 includes an upper half 101 and a lower half 102, which are closed to each other. In another embodiment, the lock body 10 can be an integrally formed structure obtained by way of injection molding or three-dimensional (3D) printing. The above-mentioned receiving space 15 and front stop wall 151 are defined between the upper half 101 and the lower half 102 of the lock body 10. The upper half 101 includes an upper coupling edge 1011, which is extended along a periphery of the upper half 101 and includes an upper front section 1012 and an upper rear section 1013. The upper rear section 1013 is provided with an upper notch 1014. The lower half 102 includes a lower coupling edge 1021, which is extended along a periphery of the lower half 102 and corresponding to the upper coupling edge 1011. The lower coupling edge 1021 includes a lower front section 1022 corresponding to the upper front section 1012, and a lower rear section 1023 corresponding to the upper rear section 1013. The lower rear section 1023 is provided with a lower notch 1024 corresponding to the upper notch 1014. The upper notch 1014 and the lower notch 1024 together define the opening 16.

Figure 4A:
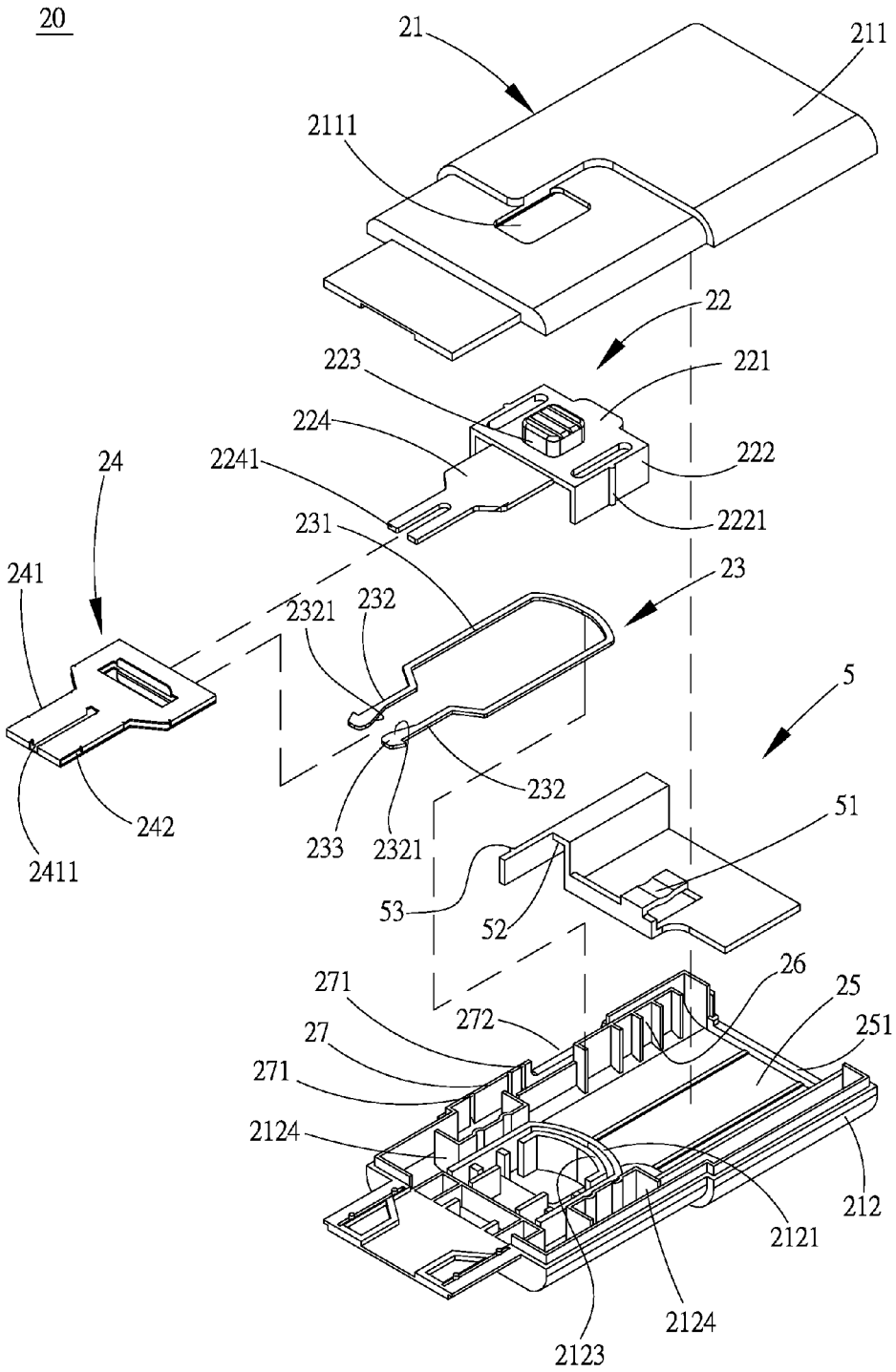
FIG. 4A is an exploded perspective view of a key member for the lock device according to the preferred embodiment of the present invention.
Figure 4B:
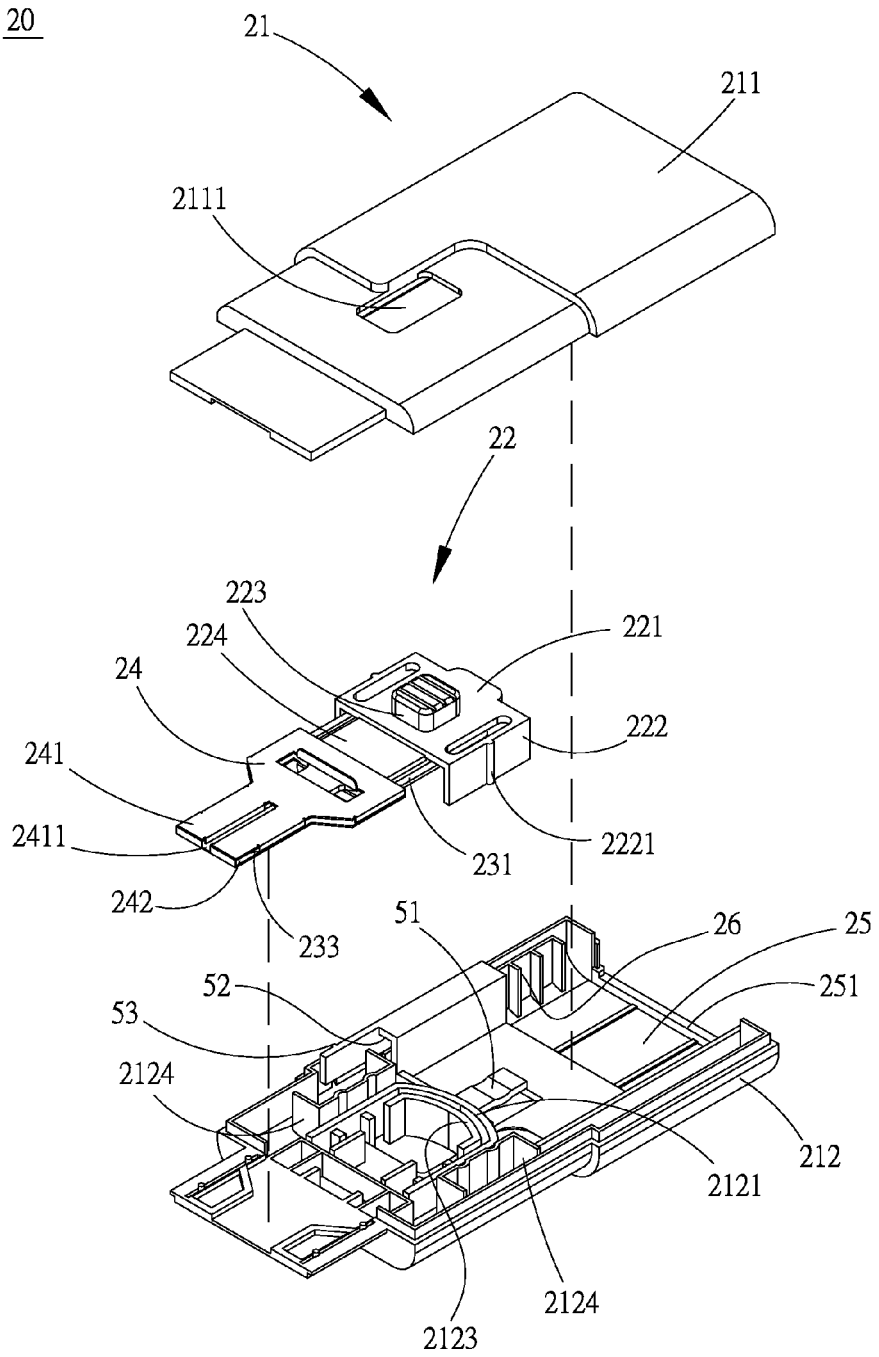
FIG. 4B is a partially assembled view of FIG. 4A.
Figure 5:
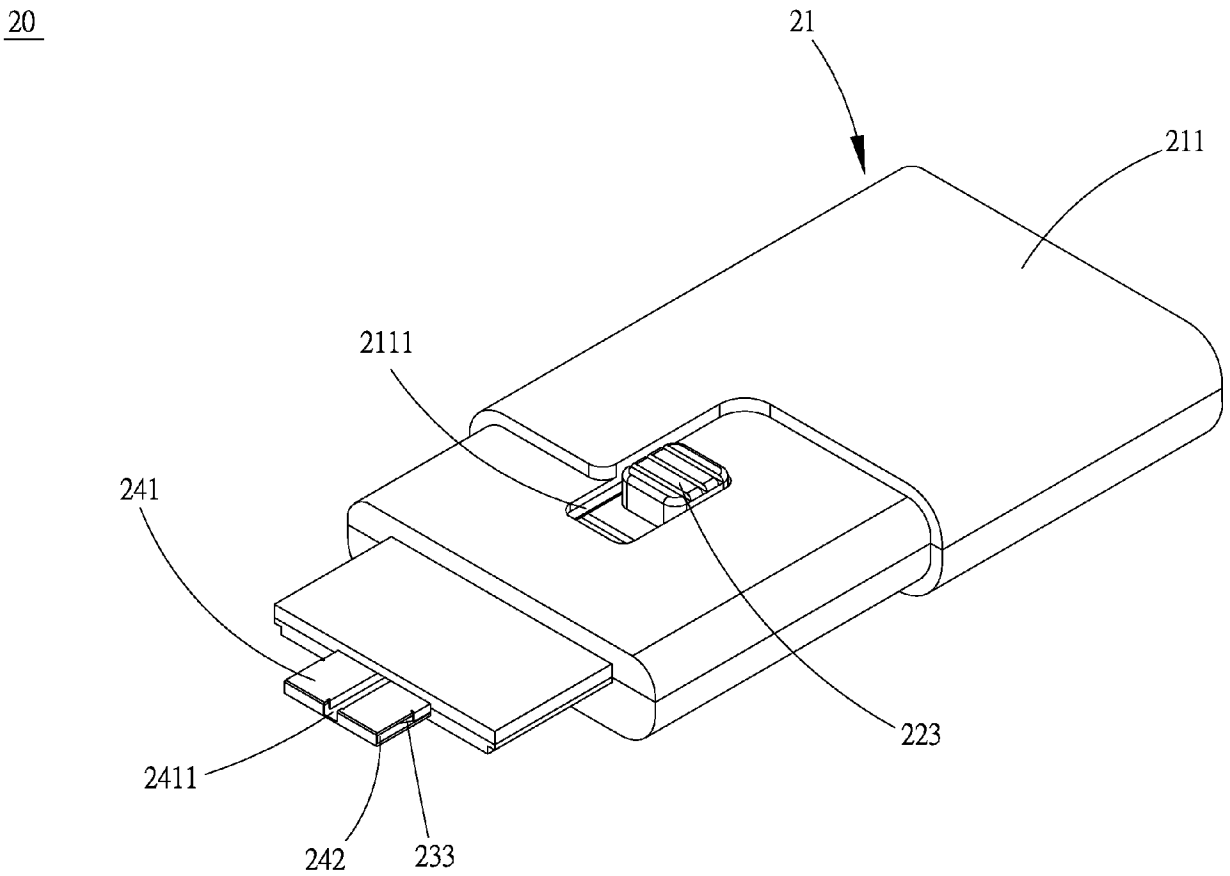
FIG. 5 is a fully assembled view of the key member of FIG. 4A.

Please refer to FIGS. 4A, 4B and 5, which are exploded, partially assembled and fully assembled perspective views, respectively, of the key member 20 for the lock device according to the preferred embodiment of the present invention. The key member 20 is provided for correspondingly inserting into the lock body 10 via the opening 16, so that the lock body 10 can be inserted into or extracted from the slot 40 through operation of the key member 20, as will described in more details later. As shown in FIGS. 4A, 4B and 5, the key member 20 includes a case 21, in which a slide element 22, a hooking element 23, an engaging element 24 and a lock body holding element 5 are received.

Figure 6A:
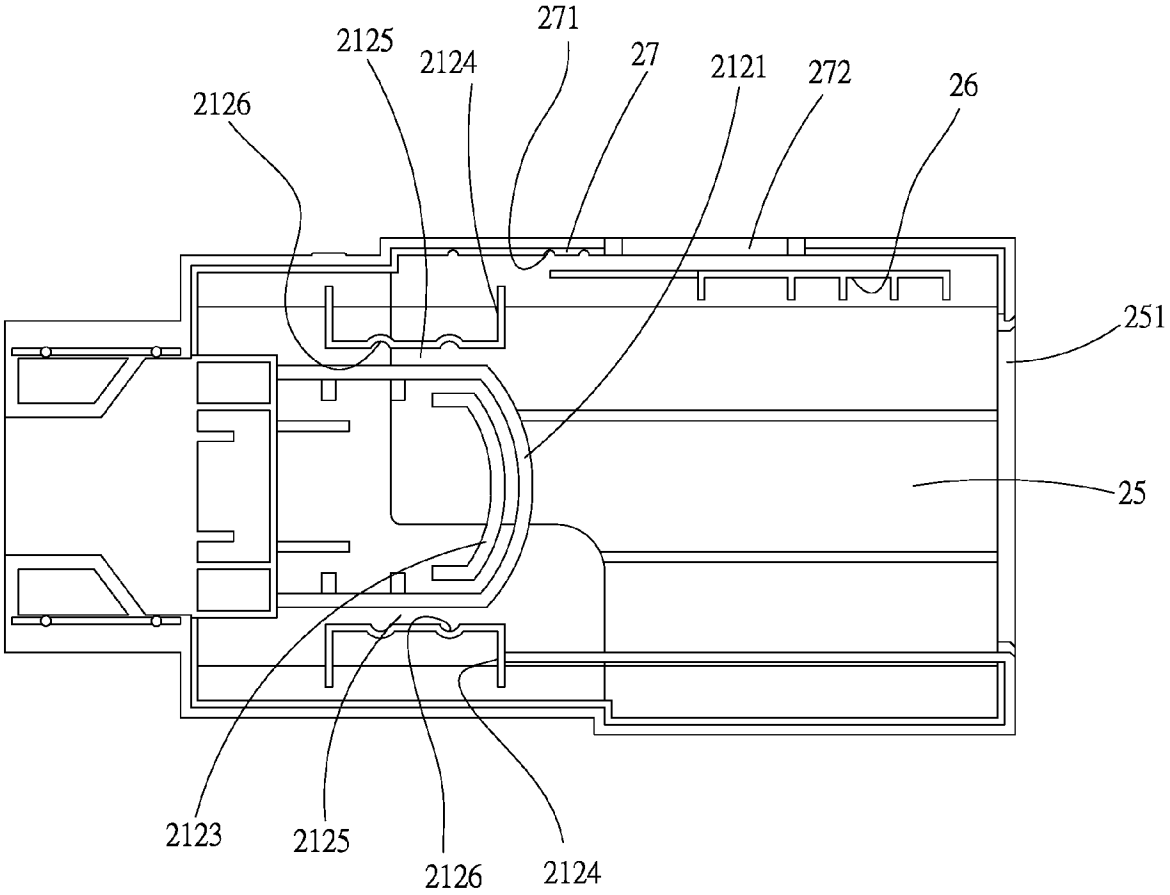
FIG. 6A is a top view of a lower case of the key member shown in FIG. 4A.
Figure 6B:
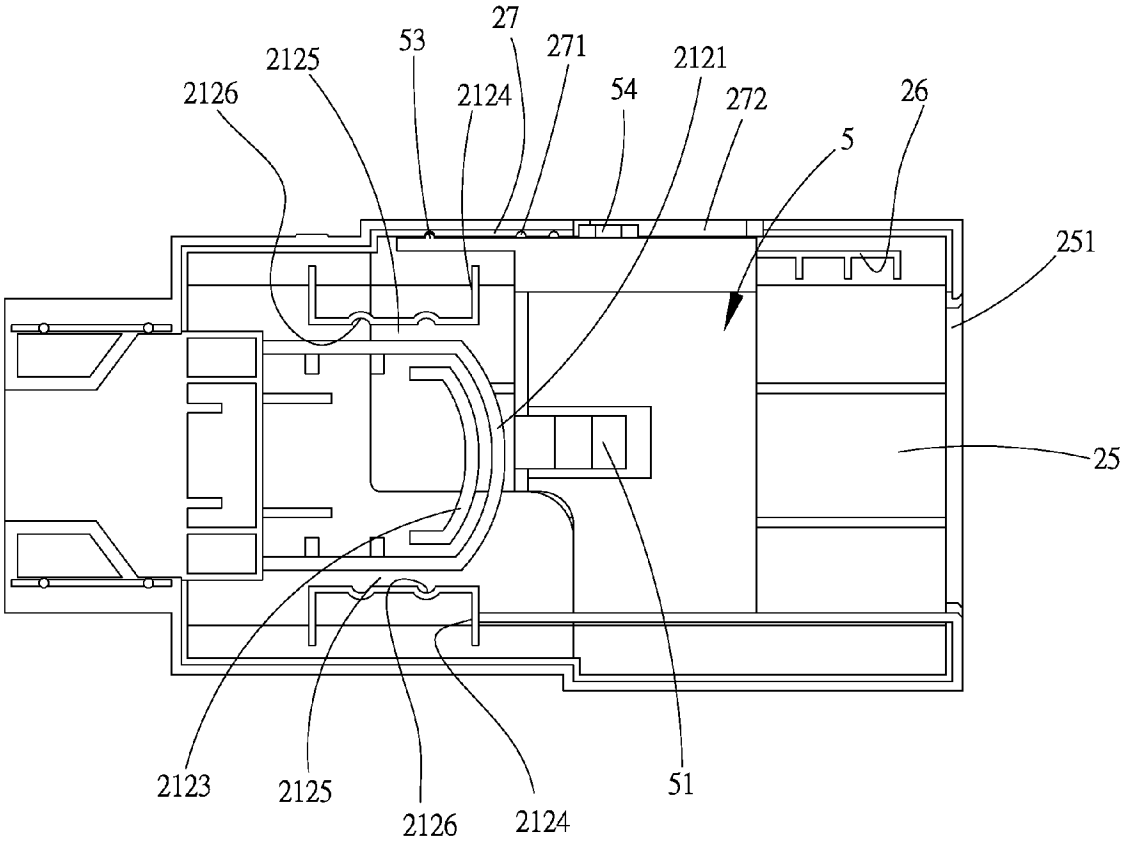
FIG. 6B is a top view of the lower case of FIG. 6A with a lock body holding element assembled thereto.
Figure 6C:
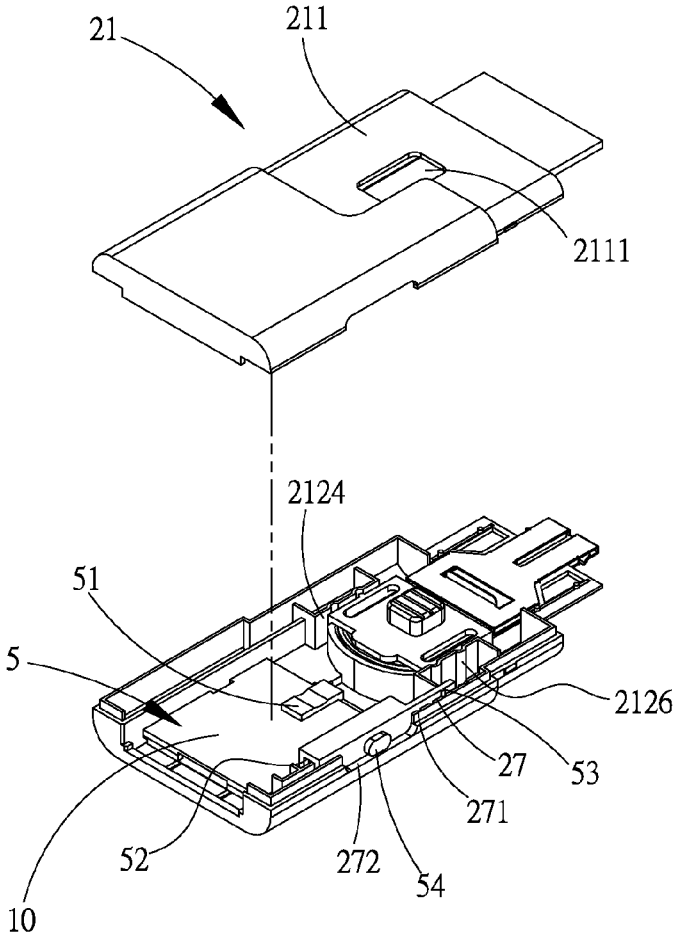
FIG. 6C is a rear perspective view of the key member with an upper case lifted from the lower case.

Please also refer to FIGS. 6A, 6B and 6C along with FIGS. 4A, 4B and 5. The case 21 includes an upper case 211 having a through hole 2111 provided thereon, and a lower case 212 correspondingly closed to the upper case 211 and internally having a middle portion 2121. In the middle portion 2121, there is provided a platform 2123. Two outer panels 2124 are located at two opposite lateral sides of the middle portion 2121, such that a guide way 2125 (see FIGS. 6A and 6B) is formed between each of the outer panels 2124 and the middle portion 2121. Each of the outer panels 2124 is provided with at least one locating groove 2126. In the illustrated preferred embodiment, there are shown two locating grooves 2126 on each of the outer panels 2124 (see FIGS. 6A and 6B). The case 21 further internally includes a chamber 25 located behind the middle portion 2121, and is formed on a rear end with a rear opening 251, which is communicable with the chamber 25. The lock body 10, when not in use, can be disposed in the chamber 25 via rear opening 251. The lock body holding element 5 is movably mounted in the chamber 25. The lower case 212 has a lateral wall portion 27, on which a plurality of locating grooves 271 and a side opening 272 are provided, and a guide panel 26 located adjacent to but spaced from the lateral wall portion 27. The slide element 22 is correspondingly disposed on the middle portion 2121 of the lower case 212. The slide element 22 includes a top panel 221, two lateral panels 222 downward extended from two opposite lateral sides of the top panel 221, a top push knob 223 located on the top panel 221 to upward expose from the upper case 211 via the through hole 2111, and a driving plate 224 forward projected from a front end of the top panel 221 and having a first projected end 2241. The two lateral panels 222 are respectively provided with a stop rib 2221, and are located in the two guide ways 2125. When the slide element 22 is forward pushed, the two lateral panels 222 are brought to move in along the two guide ways 2125 until the stop ribs 2221 on the lateral panels 222 interfere with the locating grooves 2126 on the two outer panels 2124. At this point, the slide element 22 has been pushed to a predetermined position and stays still.

The hooking element 23 is disposed on the platform 2123 of the lower case 212 to locate below the slide element 22. The hooking element 23 includes a main body 231, two ends of which are forward extended to form two laterally spaced extension arms 232 corresponding to the driving plate 224 of the slide element 22. Two free ends of the two extension arms 232 are formed into two hooks 233. The two extension arms 232 have two facing sides, which form two rearward outward slant sides 2321.

The engaging element 24 includes a second projected end 241, which is forward projected from the case 21 for aligning with the opening 16 of the lock body 10. The second projected end 241 is provided on two lateral sides with a small opening 242 each. The two extension arms 232 of the hooking element 23 are located inside the engaging element 24 with the two hooks 233 located corresponding to the two small openings 242.

The lock body holding element 5 includes a clip portion 51 for elastically holding the lock body 10 in the chamber 25, as shown in FIG. 6C, a guide portion 52 located corresponding to the guide panel 26, a stop protrusion 53 located corresponding to the locating grooves 271 (see FIGS. 6B and 6C), and a side push knob 54 exposed from the side opening 272 on the lower case 21. With the guide portion 52 fitted on the guide panel 26, the lock body holding element 5 can be moved forward and rearward in the chamber 25. When the stop protrusion 53 is engaged with one of the locating grooves 271, the lock body holding element 5 can be held to a predetermined position in the chamber 25. To remove the lock body 10 from the chamber 25, simply push the side push knob 54 in a direction toward the rear opening 251, so that the lock body holding element 5 carrying the lock body 10 is moved from a position deep in the chamber 25 to expose from the rear opening 251 and a user may remove the lock body 10 from the chamber 25. On the other hand, to store the lock body 10 in the chamber 25, simply insert the lock body 10 into the chamber 25 via the rear opening 251. At this point, the lock body holding element 5 is located in the chamber 25 adjacent to the rear opening 251 and the lock body 10 is held to the lock body holding element 5 by the clip portion 51. Then, push the side push knob 54 in a direction opposite to the rear opening 251, so that the lock body holding element 5 is returned to the position deep in the chamber 25 and the lock body 10 is received in the chamber 25.

Figure 7:
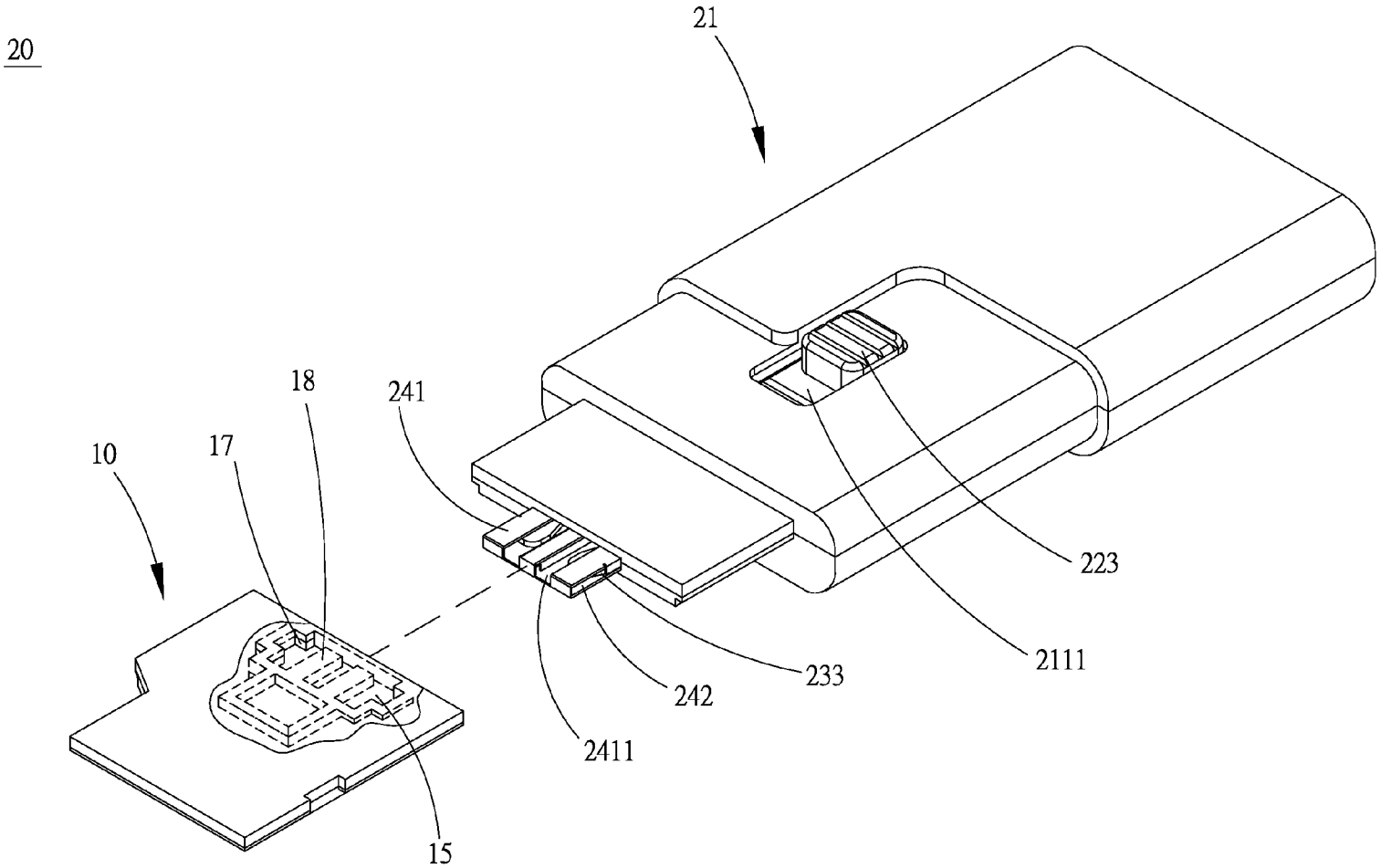
FIG. 7 shows a lock body and a key member for the lock device according to another embodiment of the present invention.

As shown in FIG. 3, the lock body 10 includes a lock core structure 18 located in the receiving space 15. Meanwhile, as shown in FIG. 4A, the second projected end 241 of the key member 20 is provided with a lock core engaging structure 2411. Every lock body 10 has a specific number of lock core structures 18, and these lock core structures 18 are shaped and arranged differently from those of other lock bodies 10. The key member 20 for a particular lock body 10 has lock core engaging structures 2411 matching the lock core structures 18 of the lock body 10. Therefore, a key member 20 having lock core engaging structures 2411 not matching the lock core structures 18 of the lock body 10 could not be inserted into the lock body 10. In the illustrated preferred embodiment, the lock body 10 has one lock core structure 18 in the form of a raised pin while the corresponding key member 20 has one lock core engaging structure 2411 in the form of a matching channel. In another operable embodiment, the lock core structure 18 can be in the form of a channel while the lock core engaging structure 2411 is in the form of a matching raised pin. In a further embodiment as shown in FIG. 7, the lock core structure 18 in the lock body 10 includes two spaced raised pins, while the lock core engaging structure 2411 in the key member 20 includes two spaced channels corresponding to the two raised pins.

Figure 8A:
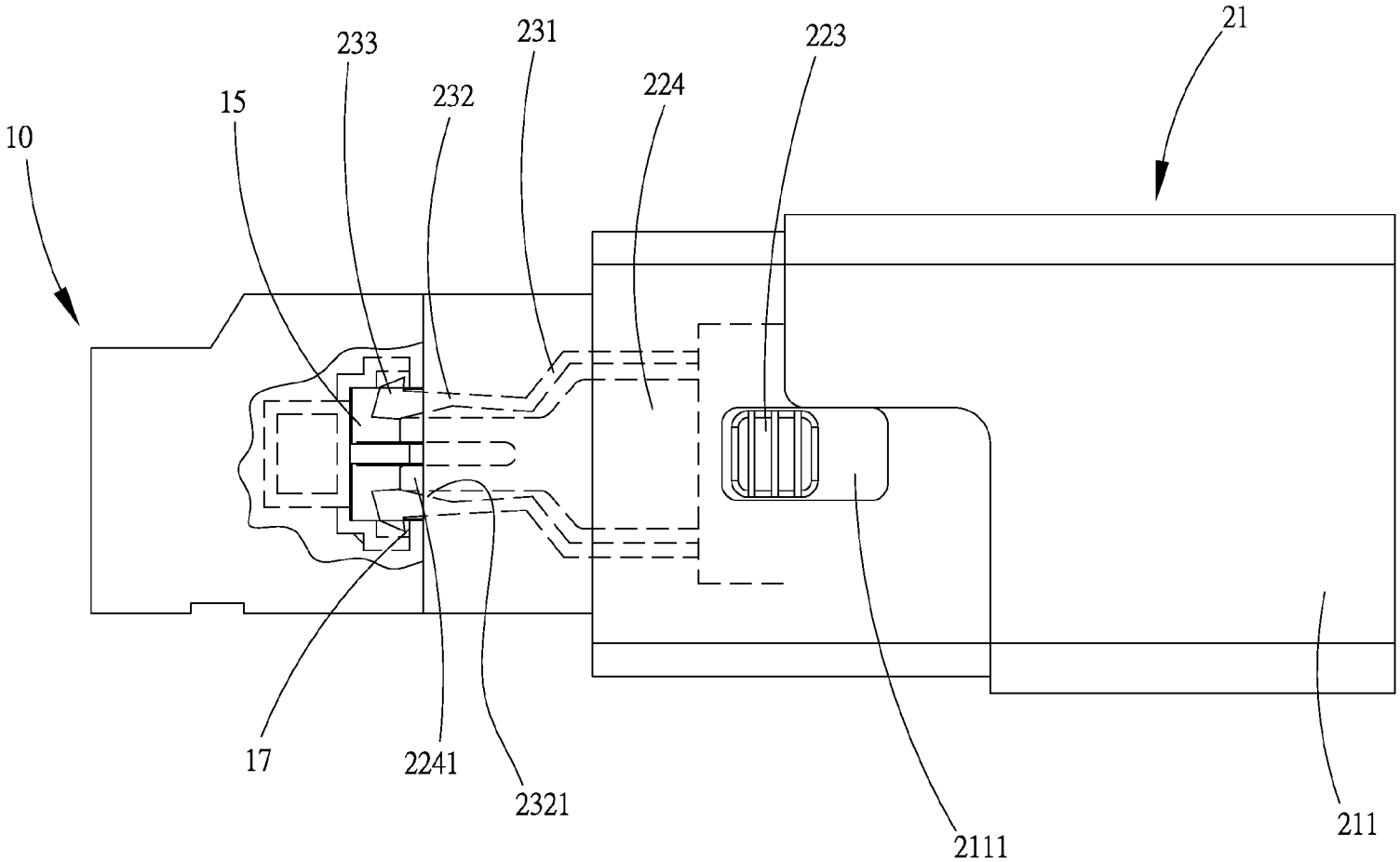
FIG. 8A shows the key member is engaged with the lock body.
Figure 8B:
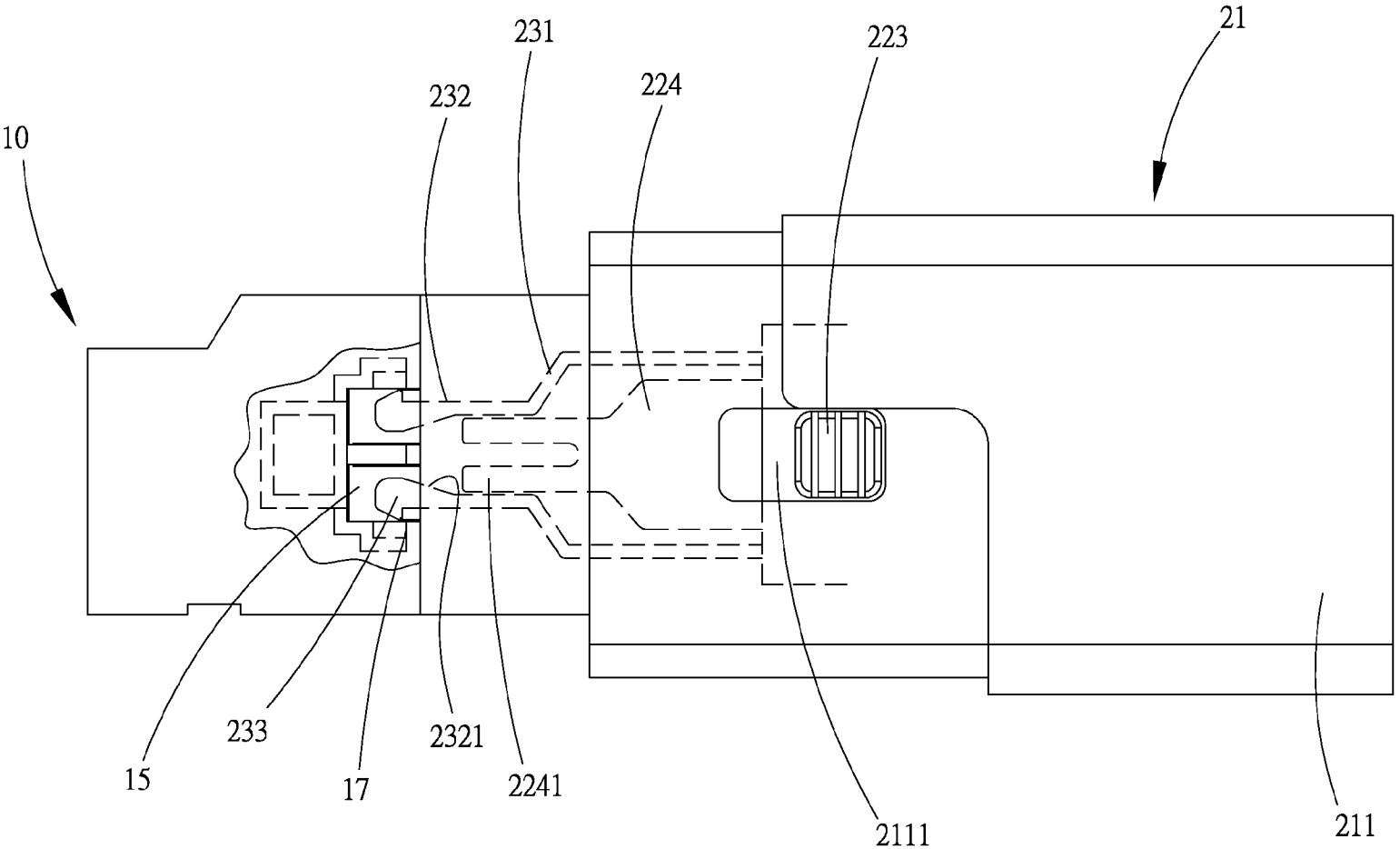
FIG. 8B shows the key member is disengaged from the lock body.

FIGS. 8A and 8B show the key member 20 engaged with and disengaged from the lock body 10, respectively. Please refer to FIG. 8A along with FIGS. 1 to 6. To engage the key member 20 with the lock body 10, simply insert the second projected end 241 of the engaging element 24 on the key member 20 into the receiving space 15 of the lock body 10 via the opening 16, so that the small openings 242 on the engaging element 24 are located inside the receiving space 15. Then, push the top push knob 223 of the slide element 22 in a direction toward the lock body 10 for the driving plate 224 to move toward the lock body 10. The first projected end 2241 of the driving plate 224 is therefore brought to press against the two facing slant sides 2321 on the two extension arms 232 of the hooking element 23, forcing the two hooks 233 at the free ends of the two extension arms 232 to expose from the small openings 242 on the engaging element 24 and abut against inner sides of the two abutment sections 17 of the lock body 10. Then, pull the case 21 of the key member 20 in a direction opposite to the lock body 10, and the lock body 10 can be rearward moved along with the key member 20. Please refer to FIG. 8B along with FIGS. 1 to 6. On the other hand, to disengage the key member 20 from the lock body 10, simply push the top push knob 233 of the slide element 23 in a direction opposite to the lock body 10. At this point, the first projected end 2241 of the driving plate 224 is brought to separate from the two slant sides 2321 of the two extension arms 232, allowing the two extension arms 232 to return to their original positions and bringing the two hooks 233 at the free ends of the extension arms 232 to retract to positions behind the two small openings 242 and accordingly no longer abut against the retaining sections 17 of the lock body 10. At this point, the key member 20 can be disengaged from the lock body 10.

Figure 9A:
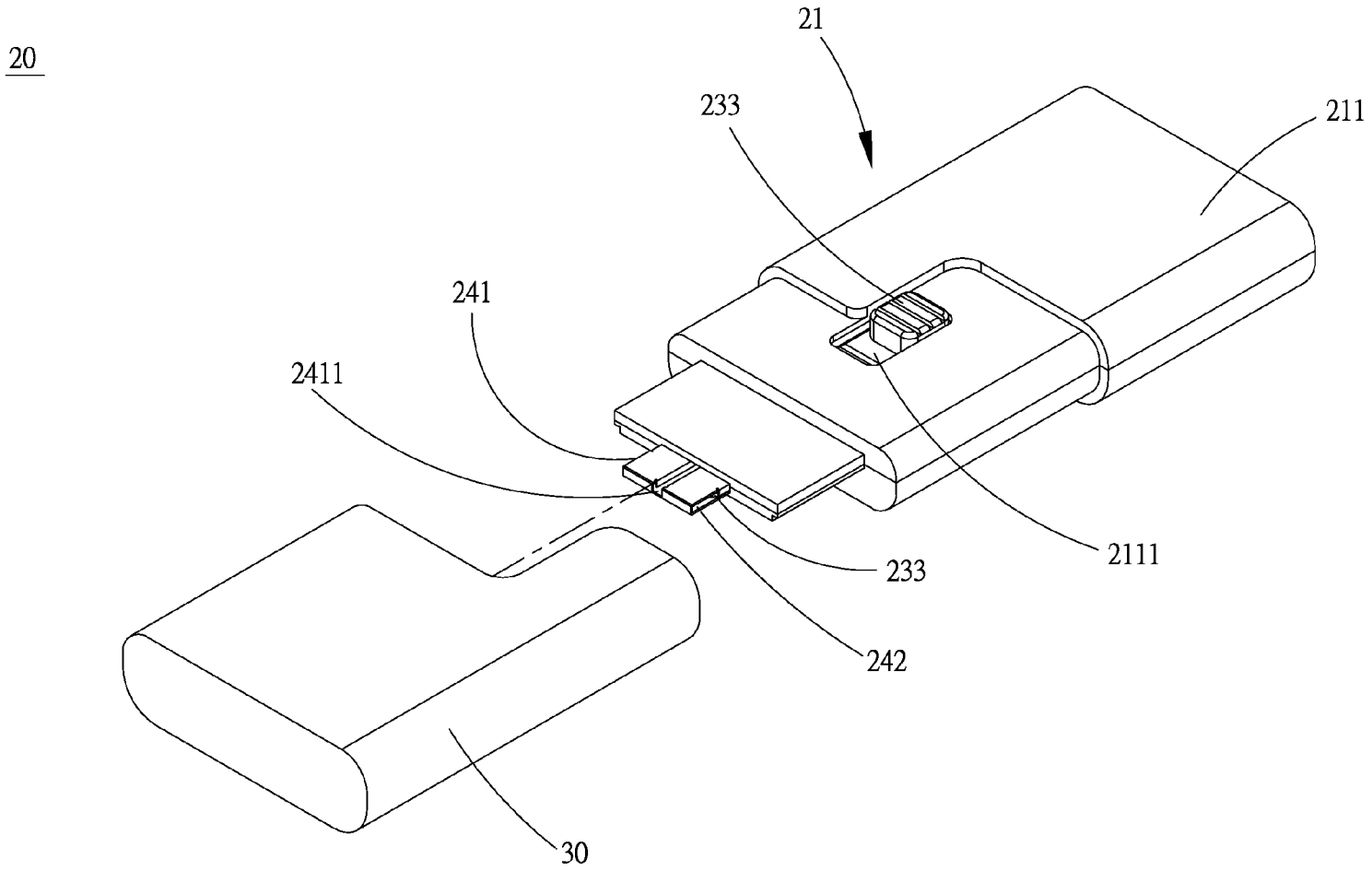
FIG. 9A shows the key member and a protective cover thereof.
Figure 9B:
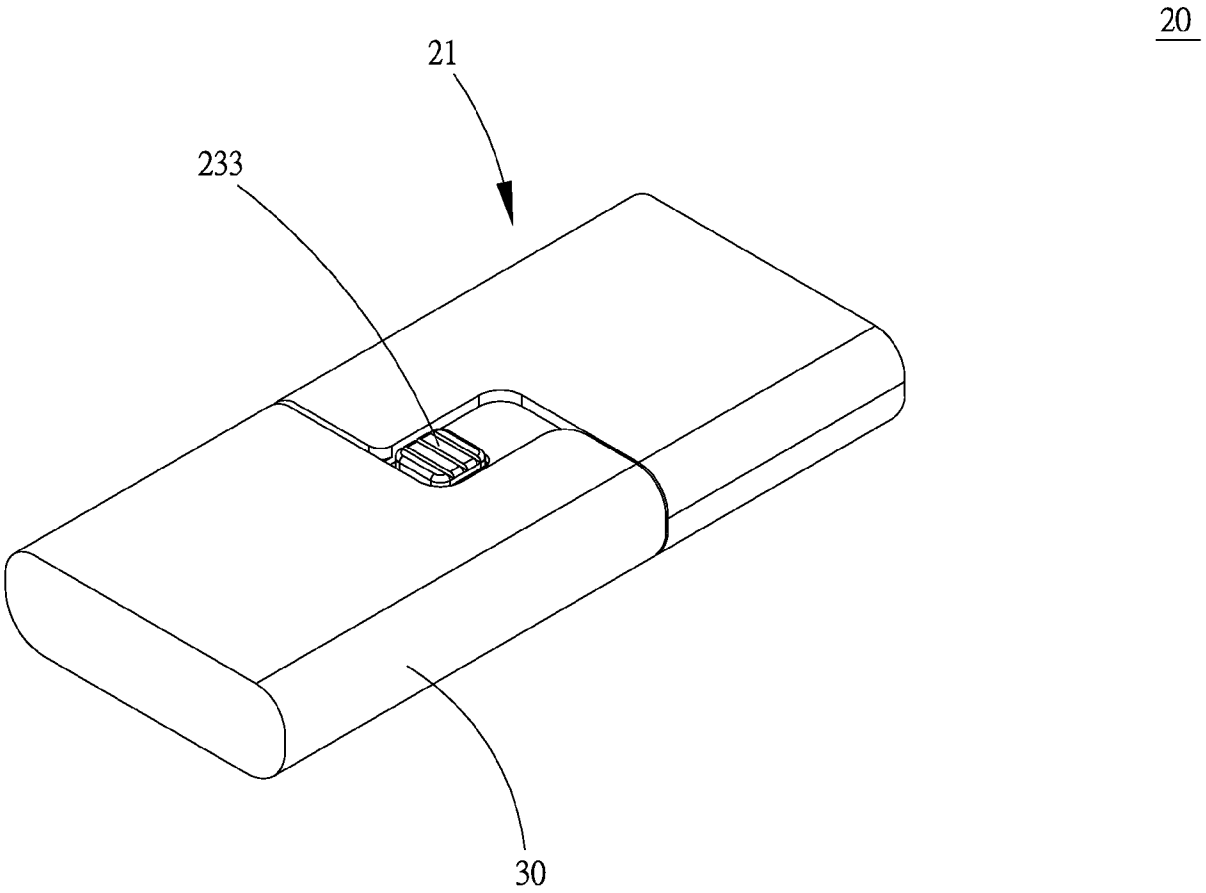
FIG. 9B shows the key member is closed by the protective cover.

Please refer to FIGS. 9A and 9B. The key member 20 can further include a protective cover 30 for removably fitting on the case 21 to enclose the second projected end 241 of the engaging element 24 in the protective cover 30.

FIG. 10 shows the lock body 10 is inserted into a slot 40 on an electronic apparatus. As shown, the slot 40 has an access opening 41 communicating the slot 40 with an external environment, and a plurality of terminals 42 located inside the slot 40 for electrically contacting with a plurality of terminals in an access device. The terminals 42 respectively have a front end formed with a protruded section 421. The access device can include but not limited to an integrated circuit (IC) card, a Secure Digital (SD) card, a Near Field Communication (NFC) card, a Compact Flash (CF) card, a Smart Media card (SMC), a Multi-Media card (MMC), and a Memory Stick (MS). By following the description with reference to FIGS. 8A and 8B, the lock body 10 can be engaged with the key member 20. Then, the lock body 10 connected to the second projected end 241 of the key member 20 can be fully inserted into the slot 40 via the access opening 41 to a locked position, in which the bottom side 13 of the lock body 10 is located corresponding to the terminals 42 in the slot 40 with the retaining section 14 abutted against inner sides of the protruded sections 421 on the terminals 42 to produce an engaging force between the retaining section 14 and the protruded sections 421 to thereby lock the slot 40 with the lock body 10. To remove the lock body 10 from the slot 40, simply engage the key member 20 with the lock body 10 and then pull the key member 20 to extract the lock body 10 from the slot 40.

It is noted when the lock body 10 is inserted into the slot 40 and in the locked position, the rear end 12 of the lock body 10 does not protrude from the access opening 41 of the slot 40, i.e. the rear end 12 of the lock body 10 is flash with the access opening 41 or retracted from the access opening 41 by a predetermined distance, so as to prevent the lock body 10 from being arbitrarily extracted from the slot 40.

In summary, the lock body for the lock device of the present invention is designed for inserting into a slot on an electronic apparatus to firmly abut the retaining section of the lock body against the terminals in the slot, preventing the lock body from being arbitrarily extracted from the slot. With the lock body being held to the locked position in the slot, an unauthorized user could not arbitrarily insert any other IC card or memory card into the slot to read or record any data stored in the electronic apparatus. And, the lock body can only be inserted into or extracted from the slot with the matched key member. Each lock body includes a lock core structure that can only engage with a lock core engaging structure provided on the matched key member. Therefore, the slot could not be unlocked if an unauthorized user tries to use a not matched key member to extract the lock body.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A lock device for electronic apparatus, the electronic apparatus including a slot having a plurality of terminals provided therein and the terminals in the slot respectively having a protruded section formed on a front end thereof, comprising:

a lock body being configured for correspondingly inserting into the slot on the electronic apparatus, and having a front end, a rear end, and a bottom side defined between the front and the rear end and having at least one retaining section provided thereon; and the bottom side of the lock body inserted into the slot being located corresponding to the terminals in the slot to abut against inner sides of the terminals and thereby hold the lock body to a locked position in the slot, wherein the lock body internally defines a receiving space and is provided on the rear end with an opening communicable with the receiving space; a front stop wall being provided in the receiving space opposite to the opening, and two abutment sections being formed in the receiving space at two opposite lateral ends of the opening; and wherein the rear end of the lock body is located in the slot without protruding from the slot when the lock body is held to the locked position.

2. The lock device for electronic apparatus as claimed in claim 1, wherein the lock body includes an upper half and a lower half correspondingly closed to each other; and the receiving space and front stop wall being defined between the upper half and the lower half of the lock body.

3. The lock device for electronic apparatus as claimed in claim 2, wherein the upper half of the lock body includes an upper coupling edge extended along a periphery of the upper half and having an upper front section and an upper rear section, and the upper rear section being provided with an upper notch; the lower half including a lower coupling edge extended along a periphery of the lower half and configured corresponding to the upper coupling edge, the lower coupling edge having a lower front section corresponding to the upper front section and a lower rear section corresponding to the upper rear section, and the lower rear section being provided with a lower notch corresponding to the upper notch; and the upper notch and the lower notch together defining the opening on the rear end of the lock body.

4. The lock device for electronic apparatus as claimed in claim 1, further comprising a key member for detachably engaging with the opening of the lock body; the key member including:

a case;

a slide element being disposed in the case and including a top panel, two lateral panels downward extended from two opposite lateral sides of the top panel, a top push knob located on and upward protruded from the top panel, and a driving plate forward projected from a front end of the top panel and having a first projected end; and the two lateral panels being respectively externally provided with a stop rib;

a hooking element being disposed in the case to locate below the slide element, and including a main body, two ends of which are forward extended to form two laterally spaced extension arms corresponding to the driving plate of the slide element; the two extension arms being formed at respective free end with a hook, and having two facing sides that form two rearward outward slant sides; and an engaging element being disposed in the case and including a second projected end forward projected from the case; the second projected end being provided on two lateral sides with a small opening each; and the two extension arms of the hooking element being located inside the engaging element with the two hooks located corresponding to the two small openings; and the second projected end being configured corresponding to the opening of the lock body for detachably inserting into the receiving space of the lock body via the opening, such that the small openings on the second projected end are located in the receiving space; and the slide element being forward slidable for the first projected end to press against the two facing slant sides of the two extension arms of the hooking element and thereby force the two hooks at the free ends of the two extension arms to expose from the two small openings and abut against inner sides of the two abutment sections of the lock body.

5. The lock device for electronic apparatus as claimed in claim 4, wherein the case of the key member includes an upper case having a through hole, via which the top push knob of the slide element is exposed from the upper case; and a lower case being correspondingly closed to the upper case and internally having a middle portion; in the middle portion there being provided a platform for supporting the hooking element thereon; two outer panels being located at two opposite lateral sides of the middle portion, such that a guide way is formed between each of the outer panels and the middle portion for receiving the two lateral panels of the slide element therein; and the outer panels being respectively provided with at least one locating groove for correspondingly engaging with the stop ribs on the lateral panels of the slide element.

6. The lock device for electronic apparatus as claimed in claim 5, wherein the key member further includes a protective cover for removably fitting on the case.

7. The lock device for electronic apparatus as claimed in claim 4, wherein the lock body includes a lock core structure located in the receiving space, and the key member including a lock core engaging structure provided on the second projected end for fitly engaging with the lock core structure of the lock body.

8. The lock device for electronic apparatus as claimed in claim 7, wherein the lock core structure has a configuration selected from the group consisting of at least one raised pin and at least one channel; and the lock core engaging structure having a configuration selected from the group consisting of at least one channel matching the raised pin of the lock core structure and at least one raised pin matching the channel of the lock core structure.

9. The lock device for electronic apparatus as claimed in claim 5, wherein the case of the key member internally includes a chamber located behind the middle portion and is formed on a rear end with a rear opening communicable with the chamber; the chamber being configured for receiving the lock body therein when the lock body is not in use, and having a lock body holding element movably provided therein for holding the lock body thereto.

10. The lock device for electronic apparatus as claimed in claim 9, wherein the lower case of the case of the key member has a lateral wall portion and a guide panel; the lateral wall portion being provided at predetermined positions with a plurality of locating grooves and a side opening, and the guide panel being located adjacent to but spaced from the lateral wall portion; and the lock body holding element includes a clip portion for elastically holding the lock body to the lock body holding element, a guide portion located corresponding to the guide panel of the lower case, a stop protrusion located corresponding to the locating grooves on the lateral wall portion of the lower case, and a side push knob exposed from the side opening on the lateral wall portion.

* * * * *